United States Patent [19]

Becker et al.

[11] Patent Number: 4,550,038

[45] Date of Patent: Oct. 29, 1985

[54] DRAPERY

[76] Inventors: William A. Becker, 87 Piermont Ave., Hillsdale, N.J. 07642; Richard A. Marlow, 703 Butternut Dr., Franklin Lakes, N.J. 07417; William I. Schlags, 2100 Linwood Ave., Apt. 8L, Fort Lee, N.J. 07024

[21] Appl. No.: 538,564

[22] Filed: Oct. 3, 1983

Related U.S. Application Data

[63] Continuation-in-part of Ser. No. 502,713, Jun. 9, 1983, and Ser. No. 502,646, Jun. 9, 1983, and a continuation-in-part of Ser. No. 451,033, Dec. 20, 1982.

[51] Int. Cl.[4] ..... A47H 23/00

[52] U.S. Cl. ..... 428/12; 160/330; 428/156

[58] Field of Search ..... 160/84 R, 330, 388; 52/70; 428/12, 156, 181

[56] References Cited

U.S. PATENT DOCUMENTS

| | | | |
|---|---|---|---|
| 2,032,068 | 2/1936 | Hooper | 160/330 X |
| 2,829,081 | 4/1958 | Sweem | 160/84 R X |
| 3,321,781 | 5/1967 | Reich | 160/330 X |
| 4,022,138 | 5/1977 | Strickland | 112/146 |
| 4,119,134 | 10/1978 | Morken | 160/349 R |
| 4,188,991 | 2/1980 | Boyle | 160/330 X |
| 4,391,865 | 7/1983 | Constance | 428/74 |
| 4,397,347 | 8/1983 | Brabant | 160/84 R X |
| 4,424,849 | 1/1984 | Robertson | 160/330 X |
| 4,450,498 | 5/1984 | Siegal | 361/216 X |
| 4,466,476 | 8/1984 | Fairbanks | 160/330 |

FOREIGN PATENT DOCUMENTS

| | | | |
|---|---|---|---|
| 370176 | 4/1932 | United Kingdom | 160/84 R |

*Primary Examiner*—Henry F. Epstein
*Attorney, Agent, or Firm*—Edward R. Weingram

[57] ABSTRACT

A drapery is provided comprising a plurality of parallel rigidized panels. Adjacent panels are hingedly joined to each other along their adjacent edges. A means for hanging said drapery on a curtain rod is provided. When the drapery is folded, the adjacent panels fold one upon the other, and when the drapery is extended, the adjacent panels form a continuous drapery.

8 Claims, 7 Drawing Figures

10
16
12
16
18
22
12
26
20
24

DRAPERY

RELATED APPLICATIONS

This application is a continuation-in-part of Design Patent Applications U.S. Ser. No. 502,713, filed June 9, 1983 and Ser. No. 502,646, filed on June 9, 1983, both to Becker, et al, and both entitled "Drapery" and this application is also a continuation-in-part of U.S. Ser. No. 451,033, filed Dec. 20, 1982, to Becker, et al entitled "Apparatus for Mounting Hanging Fabrics. The entire disclosures of all of these applications are incorporated herein by reference.

BACKGROUND OF THE INVENTION

1. Field of the Invention

This invention relates to drapery, typically for windows, which is comprised of a plurality of panels, and may be hung on a curtain rod.

2. Description of the Prior Art

There are numerous types of curtains and drapery known in the art. One particular type of curtain is a continuous fabric type curtain which is joined to a curtain rod by hooks or slides. This particular type curtain has several undesirable features, principally among these are the fact that it is difficult to open the drape or curtain, due to the fabric not having a foldable pleat therein. Attempts to resolve this involve pleating or pinning the curtain at the top of the fabric to assist in opening the curtains. Another drawback of this invention is that unless the entire fabric is made diaphanous, or "see through", such curtains will not transmit light. If the curtain is made completely diaphanous, then it is possible for persons on the outside to look in. This may be undesirable.

Another type drapery is known as "vertical blinds". These "blinds" consist of a plurality of parallel rigidized panels which are joined to each other, typically at the tops and bottoms, by a plurality of chains which permit their opening and closing upon one another. The panels also slide upon a track at the top and/or bottom. One of the major drawbacks of this type drapery is that the mechanisms are fairly complicated and tend to malfunction quite often.

OBJECTS AND SUMMARY OF THE INVENTION

The present invention is directed to a drapery which comprises a plurality of parallel rigidized panels, wherein the adjacent panels are hingedly joined to each other along their adjacent edges. A means is provided for hanging said drapery on a curtain rod. When the drapery is folded the adjacent panels fold one upon the other, and when the drapery is extended adjacent panels form a continuous drapery.

Accordingly, it is an object of this invention to provide a durable, relatively inexpensive drapery which does not wrinkle, does not require separate pinning to make the drapery fall in a proper fashion, and is extremely flexible.

A further object of this invention is to provide a drapery which can be easily and inexpensively installed, and has a minimum of associated hardware and can be mounted to simple fittings well known in the art.

It is a further object of this invention to provide a drapery which does not require an elaborate mounting track, is relatively light weight and does not require periodic pressing or pinning to create the pleats for folding.

It is still a further object of this invention to provide a drapery which can be used to cover a wide and variable area by the same drape depending upon how far the drapery is extended.

It is another object of this invention to provide a drapery which can be mounted to the well known plain curtain rod, is relatively inexpensive to manufacture, has a relatively wide variety of uses, and can be used for full length or short length drapes.

It is still another object of this invention to provide a drapery which covers a wide area and can be opened from either end or from the middle and is extremely flexible as to the manner of mounting.

It is a further object of this invention to provide a drapery which can be easily removed and mounted.

It is a further object of this invention to provide a drapery having a minor portion of the drapery which is diaphanous, thus permitting light to pass therethrough, and a major portion of the drapery which is impermeable to light to prevent persons from looking therethrough.

Various other objects and advantages will be apparent from the following description of an embodiment of the invention in which description reference will be made to the accompanying drawings.

The invention will be described with reference to the accompanying drawings, illustrating a preferred embodiment which is described in this specification. However, the invention is not limited to this preferred embodiment since other modifications will be readily apparent to those skilled in the art. The scope of this invention is defined in the claims following this specification.

DETAILED DESCRIPTION OF A PREFERRED EMBODIMENT

Figure 1:
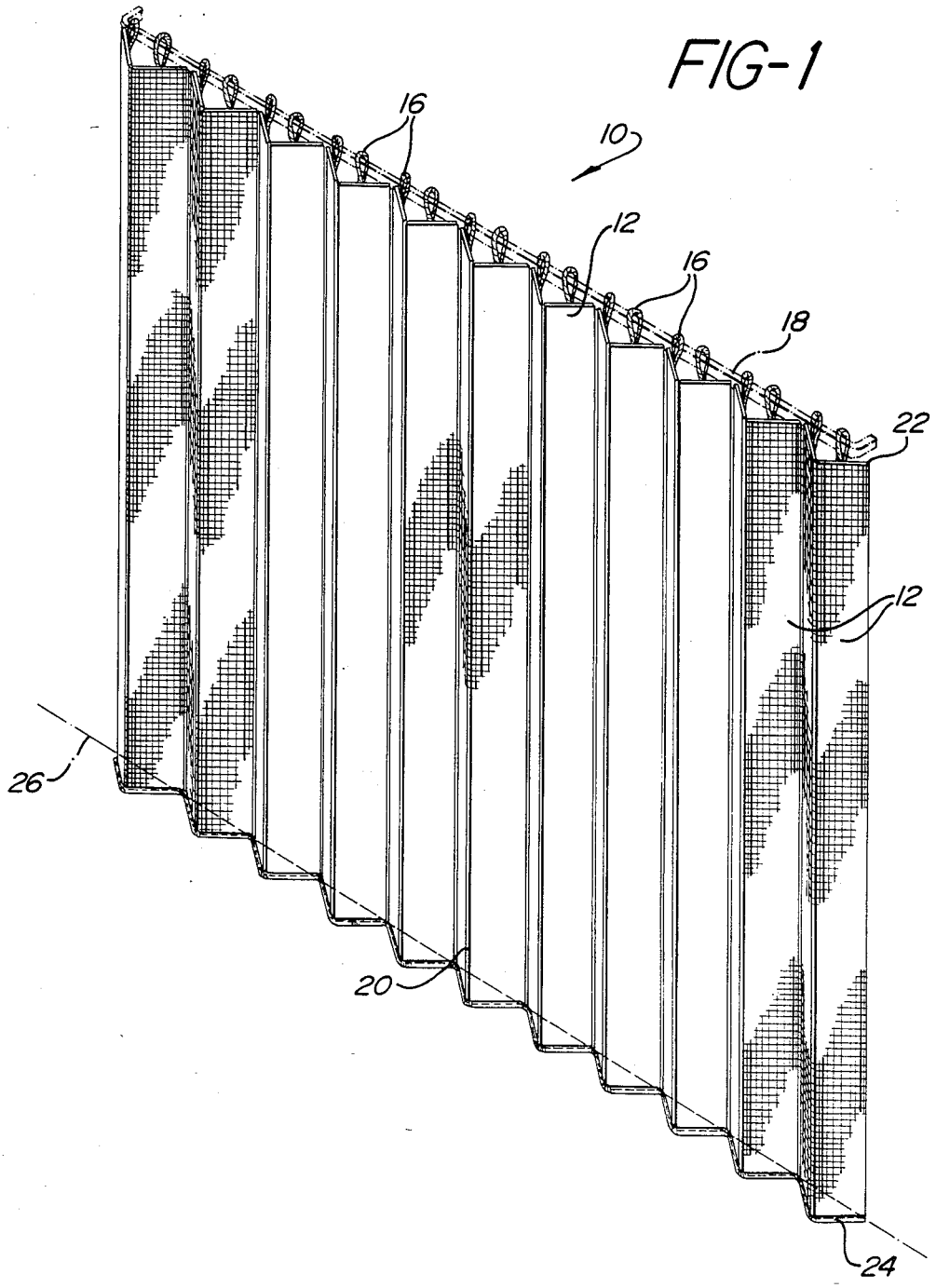
FIG. 1 is a perspective view of the drapery of this invention hanging on a curtain rod.
Figure 2:
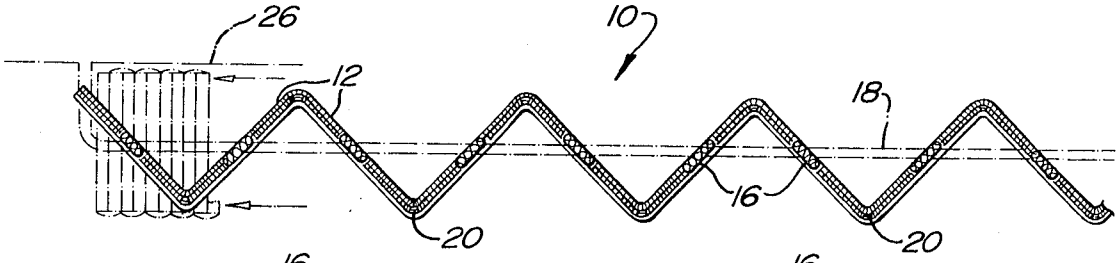
FIG. 2 is a top view of the drapery of this invention extended (solid lines) and folded (dotted lines).
Figure 3:
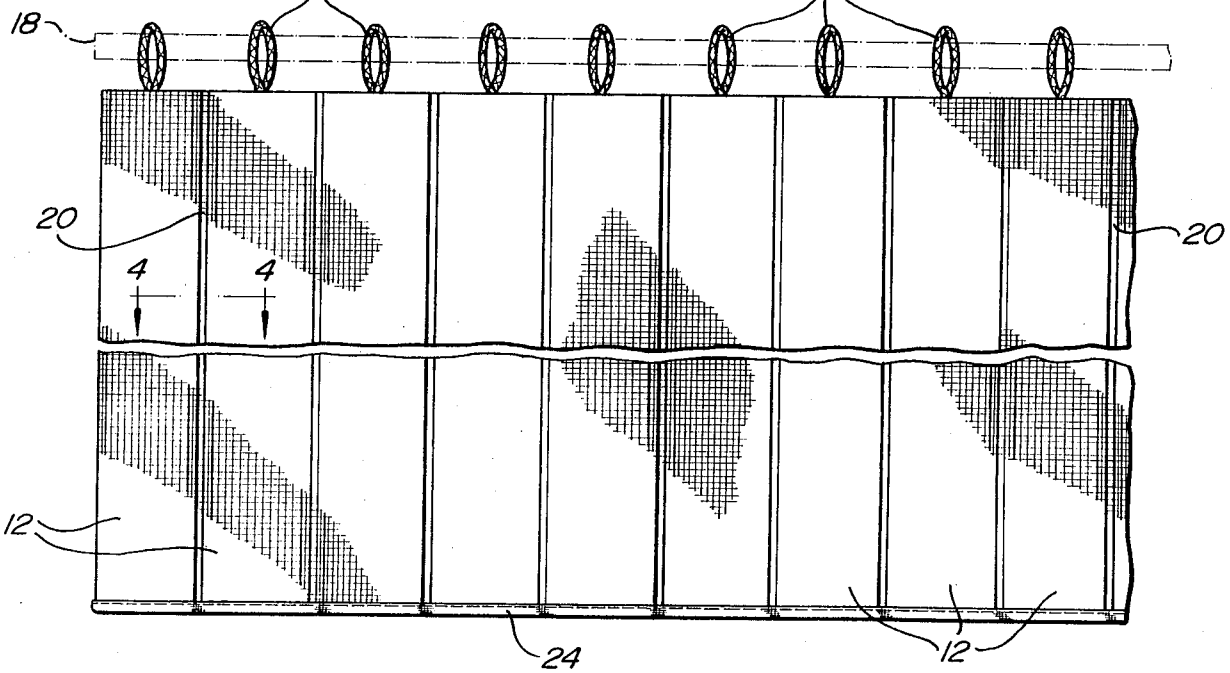
FIG. 3 is a front view of the drapery of this invention extended.

Referring to FIGS. 1-5, a drapery 10 is provided, comprising a plurality of parallel rigidized panels 12. Adjacent panels 12 are hingedly joined to each other along their adjacent edges 14. A means, e.g. loop 16, is provided for hanging said drapery 10 on a curtain rod 18. When the drapery 10 is folded, the adjacent panels 12 fold one upon the other (FIG. 4—dotted lines), and when the drapery 10 is extended, the adjacent panels 12 form a continuous drapery (FIGS. 1 and 3).

Figure 4:
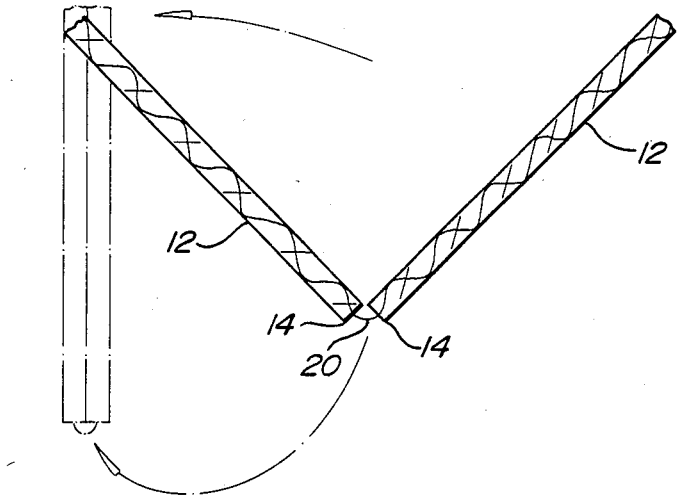
FIG. 4 is a top view of a portion of the drapery of this invention showing two adjacent panels.
Figure 5:
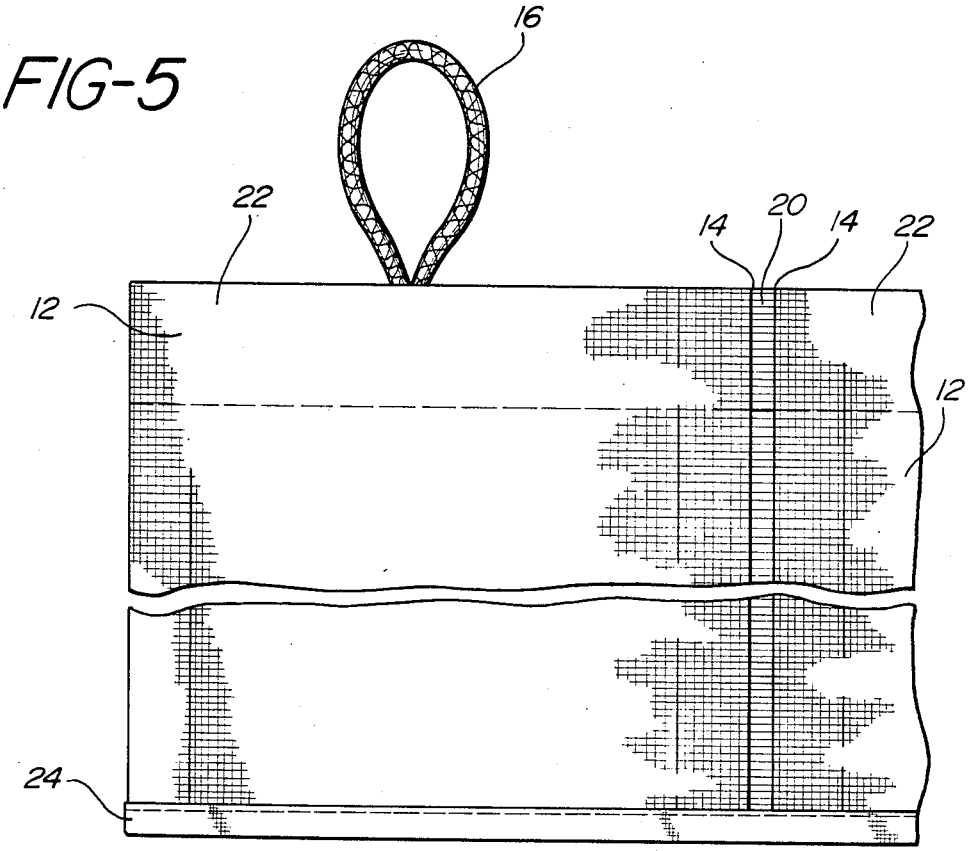
FIG. 5 is a side view of the drapery of this invention showing two adjacent panels.
Figure 6:
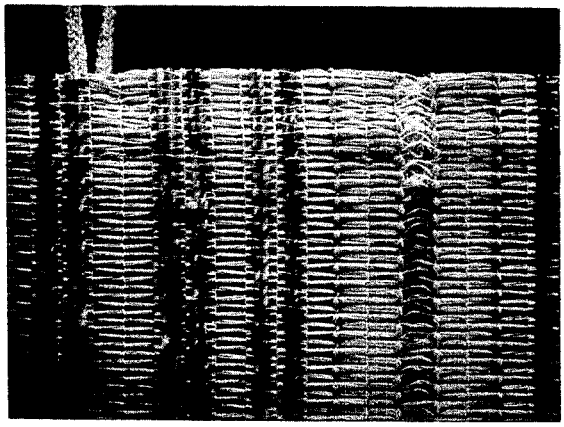
FIG. 6 is a photograph of the front of a drapery showing a loop thereon for hanging on a curtain rod.
Figure 7:
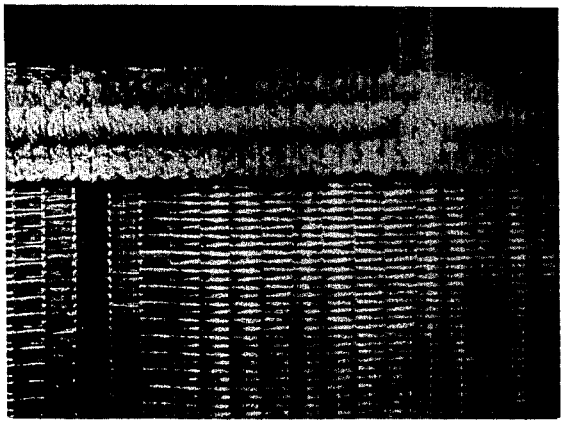
FIG. 7 is a photograph of the rear of the drapery showing a loop thereon for hanging on a curtain rod.

As shown more clearly in FIGS. 4 and 5 and photographs 6 and 7, the preferred panels 12 are fabric panels which are thick enough to be considered "rigidized". By the term "rigidized" as used herein, it is meant that the panel 12 is sufficiently rigid to form a planar panel without substantial folds or creases therein to permit adjacent panels 12 to fold one upon the other when the drapery is folded (see FIG. 4—dotted lines), and when the drapery is extended, the adjacent panels form a continuous drapery. This requires a certain density of fabric for all fabric panels 12. Alternatively, the panels can be fabric covered planar cores wherein the core is made of a thin sheet metal or polymeric material. This latter type panel (not shown) is more expensive and less desirable than a completely fabric panel; but still encompassed by this invention.

As can be shown more clearly in FIGS. 4 and 5, and photographs 6 and 7, the preferred drapery of this invention hingedly joins adjacent panels 12 to each other by a length of fabric attached along the length of the adjacent edges of the fabric panels or by a plurality of threads joining the adjacent fabric edges of adjacent panels. Such fabric or thread hinge is generally designated 20 herein. The demarcation between a fabric type hinge and a thread type hinge is somewhat hazy, however, Applicants' desire to encompass in their invention both type hinges. Preferably, the fabric or thread 20 which hingedly join adjacent panels are threads of the fabric which form the panel 12 and form a continuum therewith to provide for strength and continuity of design when the drapery is open. Optionally, a border trim at the top 22 and bottom 24 of the drapery 10 may be used to reinforce the joint between the panels 12.

In the preferred embodiment of this invention, the fabric or threads as the case may be form a diaphanous area. By the use of the term "diaphanous", it is meant that the area 20 joining the adjacent edges 14 of adjacent panels 12 is characterized by a fineness of texture as to permit the passage of light therethrough. Such a diaphanous area 20 along the adjacent edges 14 of the panels permits, when the drapery is in its extended configuration, a certain amount of light to pass therethrough to light up, for example, the interior of a house. Preferably, the panels do not transmit light and prevent those from the outside from looking in.

Generally, it is difficult to quantitively define the area 20 joining adjacent edges 44 of adjacent panels 12, so that the area 20 will permit folding of the panels one upon the other, however, for general guidance, when the panels and area 20 are made of fabric, it is preferred that area 20 be less than one-fourth the density of the panel. Such a low density can provide a diaphanous area 20 between the panels 12 for certain type fabrics, and permits the panels 12 to be folded one upon the other about such area 20.

Referring to FIGS. 1, 3 and 5, in the preferred embodiment of this invention, the drapes 10 are hung on a curtain rod 18 by a loop 16 which is attached to the top center of the panel 12. The attachment may be reinforced by having top trim 22 overlap loop 16.

Typically and preferably, the panels 12 are identical to each other and, generally can be made of any length or width. Referring to FIG. 2, with respect to the width of the panel 12, this is primarily determined by the distance curtain rod 18 is away from wall 26 to permit folding of the panels one upon the other to form a tight compact area, with the thread or fabric area 20 acting as a hinge.

As shown in FIG. 1, aligning means 26 in the form of a thread anchored to each panel may be provided to facilitate spacing of the panels in the extended position so that they will lie in a uniform parallel and aligned relationship.

The drapery of this invention can be manufactured by methods well known in the art for manufacturing fabrics, fabric type materials, curtains and drapery and the invention herein does not reside in the method of manufacturing this drapery.

Although a preferred embodiment of the invention has been disclosed and described in detail herein, it should be understood that this invention is in no sense limited thereby and its scope is to be determined by that of the appended claims.

We claim:

1. A drapery comprising:

a plurality of parallel rigidized fabric panels, hinge means, hingedly joining adjacent panels to each other along their adjacent edges;

wherein adjacent panels are hingedly joined to each other by a length of hinge fabric extending along the length of adjacent edges of the panels, said hinge fabric being threads of the fabric panels and forming a continuum therewith, said hinge fabric density being less than the fabric panels; and means for hanging said drapery on a curtain rod, wherein when the drapery is folded, adjacent panels fold one upon the other, and when the drapery is extended, adjacent panels form a continuous drapery.

2. The drapery of claim 1, wherein the hinge fabric is diaphanous.

3. The drapery of claim 1, wherein the hinge fabric density is less than one-fourth the density of the panel.

4. The drapery of claim 1, wherein the panels hingedly joined to each other by a plurality of threads joining the adjacent fabric edges of adjacent panels.

5. The drapery of claim 4, wherein the threads joining the adjacent fabric edges are threads of the fabric panel and form a continuum therewith.

6. The drapery of claim 1, wherein the means for hanging comprises a loop at the top and center of each panel.

7. The drapery of claim 1, wherein each of the panels is identical in size.

8. The drapery of claim 1 further comprising, aligning means connected to adjacent panels to facilitate spacing of the panels in the extended curtain.

* * * * *